US006571682B2

(12) United States Patent
Roberts et al.

(10) Patent No.: US 6,571,682 B2
(45) Date of Patent: Jun. 3, 2003

(54) APPARATUS FOR CONVERTING CIRCULAR MOTION TO RADIAL MOTION

(75) Inventors: Clark A. Roberts, Maryville, TN (US); Sean E. Howley, Maryville, TN (US); Mark S. Byerley, Greenback, TN (US)

(73) Assignee: WYKO, Inc., Greenback, TX (US)

( * ) Notice: Subject to any disclaimer, the term of this patent is extended or adjusted under 35 U.S.C. 154(b) by 133 days.

(21) Appl. No.: 09/919,089

(22) Filed: Jul. 31, 2001

(65) Prior Publication Data

US 2003/0024383 A1 Feb. 6, 2003

(51) Int. Cl.[7] ..... F01C 9/00
(52) U.S. Cl. ..... 92/120; 92/138
(58) Field of Search ..... 92/120, 138, 130 C, 92/132; 91/533; 254/50.3, 387

(56) References Cited

U.S. PATENT DOCUMENTS 3,904,144 A * 9/1975 Gattrugeri ..... 242/571.2
4,754,543 A * 7/1988 Spivy ..... 29/557

* cited by examiner

*Primary Examiner*—Edward K. Look
*Assistant Examiner*—Michael Leslie
(74) *Attorney, Agent, or Firm*—Pitts & Brittian, P.C.

(57) ABSTRACT

In accordance with one aspect of the present invention there is provided apparatus and a method for converting circular motion to radial motion. In one embodiment of the apparatus of the present invention, a mandrel is provided which includes a generally circular tubular housing. Internally of the tubular housing there are disposed a plurality of partitions which are anchored at spaced apart locations about the toroidal dimension of the housing and which define fixed fluid-tight seals across the cross-sectional area of the housing. Within the chamber defined between adjacent ones of the partitions, there is provided a piston member, each piston member has operatively associated therewith the proximal end of a linkage adapted to convert circular motion of its piston member within the housing into radial movement of the distal end of the linkage.

9 Claims, 7 Drawing Sheets

APPARATUS FOR CONVERTING CIRCULAR MOTION TO RADIAL MOTION

BACKGROUND OF INVENTION

This invention relates generally to apparatus for converting circular motion to radial motion, particularly for applications in the manufacture of vehicle tires.

In the manufacture of vehicle tires, there are several manufacturing operations which include a variable diameter mandrel, such as the drum employed in the lay-up of a tire carcass, bead locking mechanisms, shaping drums, and transfer rings. In each such mandrel, it is required that the mandrel include means for adjusting the diameter of the mandrel, such as for establishing the desired diameter of the tire carcass, for radial collapse of the drum to facilitate removal of a formed or partially formed tire carcass from a mandrel, for radial movement of grasping and supporting shoes of a transfer ring, etc.

By way of example, in the manufacture of vehicle tires, one process operation includes positioning of a green tire carcass on a shaping drum whereupon the carcass is inflated to a generally desired toroidal shape. The green tire carcass normally is of a generally hollow cylindrical geometry having a non-extensible bead ring secured internally of each of the opposite ends of the carcass. The shaping drum of the prior art includes first and second generally cylindrical mandrels which are disposed on opposite sides of a centerplane oriented perpendicular to the longitudinal centerline of the drum. This longitudinal centerline also defines the rotational axis of the drum. The mandrels of a shaping drum are designed to engage the bead ring-containing opposite ends of the carcass and thereby hold the carcass centered on the drum relative to the centerplane and concentric with respect to the rotational axis of the drum.

Commonly, each of the two mandrels of a shaping drum is of the radially expansible type, that is, each mandrel comprises a plurality of segments which are disposed radially about the rotational axis of the drum and which collectively define generally the outer circumference of an annular receiver for one of the bead rings of the carcass. The segments of each mandrel are radially moveable relative to the rotational axis of the drum for locking the bead rings of the carcass to the drum and are laterally movable to permit initial selection of the spacing between the bead rings as the carcass. and adjustment of their lateral spacing as the carcass is radially expanded to define a green tire.

For proper functioning of the shaping drum and true rotational dimensioning of the carcass into a vehicle tire, it is important that the carcass initially be positioned precisely centrally of the shaping drum both radially of the drum and laterally of the centerplane of the drum so that upon inflation of the carcass toward a toroidal geometry, all parts of the carcass move or expand uniformly with respect to one another, thereby ensuring uniformity of symmetry of the expanded carcass, as well as uniformity of distribution of the material of construction of the carcass, and ultimately, uniformity of the radial and lateral dimensions and material distribution of the finished tire.

A typical green tire carcass for a truck tire, for example, will weigh 35–50 pounds or more and is relatively flimsy and difficult to manipulate. Accordingly, loading of the carcass onto a shaping drum is difficult in several aspects. For example, manually placing the carcass onto the drum from one end of the drum, that is "threading" of the carcass initially onto one end of the drum and further moving the carcass toward the lateral centerplane of the drum is difficult in that the carcass tends to bend, twist, collapse and/or sag due to gravity, from its open cylindrical geometry when lifted by an operator or a mechanical transfer device. After the carcass has been initially threaded onto the drum, there remains the problem of completing the centering the carcass relative to the lateral centerplane of the drum so that the bead rings are disposed on opposite sides of, and equidistantly from the centerplane of the drum and equidistant radially about the rotational axis of the drum. These and other positioning efforts are frustrated by the tendency of the carcass to "sag" under the effects of gravity thereby impeding the radial centering of the carcass relative to the longitudinal centerline of the drum before, or as, the bead rings become locked to the mandrels of the drum. Failure to center the carcass both radially and longitudinally of the shaping drum can result in non-uniform distribution of the material of the carcass, hence of the finished tire, with the result that the finished tire is unacceptably "out of round" and must be scrapped.

In the prior art, there exist numerous mechanisms for adjusting the diameter of a mandrel, such as a drum or transfer ring employed in the manufacture of vehicle tires. These mechanisms, generally, are bulky and therefore in some embodiments they occupy a considerable portion of the interior volume of a mandrel and thereby limit particularly the minimum diameter of a given mandrel, as well as limiting the maximum diameter of the drum. In other embodiments, the expansion mechanism is disposed intermediate laterally adjacent components of the mandrel (drum, etc.) and present obstacles to various relative movements of various components of the mandrel. Moreover, such prior art systems are costly to manufacture and to maintain, in part due to their complexity and/or to their location within or on the mandrel.

SUMMARY OF INVENTION

In accordance with one aspect of the present invention there is provided apparatus and a method for converting circular motion to radial motion. The present invention is particularly useful in variable diameter mandrels (drums and/or transfer rings) employed in the manufacture of vehicle tires.

In one embodiment of the apparatus of the present invention, a mandrel is provided which includes a generally circular tubular housing. Internally of the tubular housing there are disposed a plurality of partitions which are anchored at spaced apart locations about the toroidal dimension of the housing and which define fixed fluid-tight seals across the cross-sectional area of the housing. Adjacent ones of the partitions define therebetween a fluid-tight chamber whose outer wall is defined by the housing wall. Within the chamber defined between adjacent ones of the partitions, there is provided a piston member which is slidable between a first position in which one end of the piston member is adjacent a first one of its adjacent partitions and the opposite end of the piston is spaced apart from a second one of the adjacent partitions, and a second position in which the opposite end of the piston member is adjacent the second one of its adjacent partitions and the first end of the piston member is spaced apart from the first adjacent partition. In one embodiment of the apparatus, each piston member has operatively associated therewith the proximal end of a linkage adapted to convert circular motion of its piston member within the housing into radial movement of the distal end of the linkage. As desired, appropriate working elements, or the like, may be mounted on the distal ends of a plurality of linkages. In one example, the working elements may be segments which, collectively, at least partially define a circumferential dimension (hence diameter) of the mandrel. Pressurized fluid, air for example, may be employed to power the circular, preferably simultaneous, movement of the piston members disposed within the toroidal housing, hence simultaneous radial movement of the accompanying distal ends of the linkages, hence adjustment of the effective diameter of the mandrel. In a further embodiment, selected ones of the piston members, hence their associated linkages, may be moved in a clockwise direction while simultaneously, others of the piston members disposed within the housing may be moved in a counter clockwise direction, thereby causing the distal ends of selected ones of the linkages to move toward a minimum diameter while others of the distal ends of others of the linkages move toward a maximum diameter.

DETAILED DESCRIPTION OF INVENTION

Referring initially to FIGS. 1–5 there is depicted one embodiment of apparatus embodying various of the features of the present invention. In the depicted embodiment, there is provided a mandrel 12 which comprises a hollow, preferably two-piece, toroidal housing 14 having an inner circumferential wall 16. In one embodiment, the inner circumferential wall 16 of the housing is adapted to encircle and be either fixedly attached to, or slidable along the length of, a shaft (not shown), such as the main drive shaft of a vehicle tire building drum, transfer ring, or the like, all of which are well known in the art.

Figure 5:
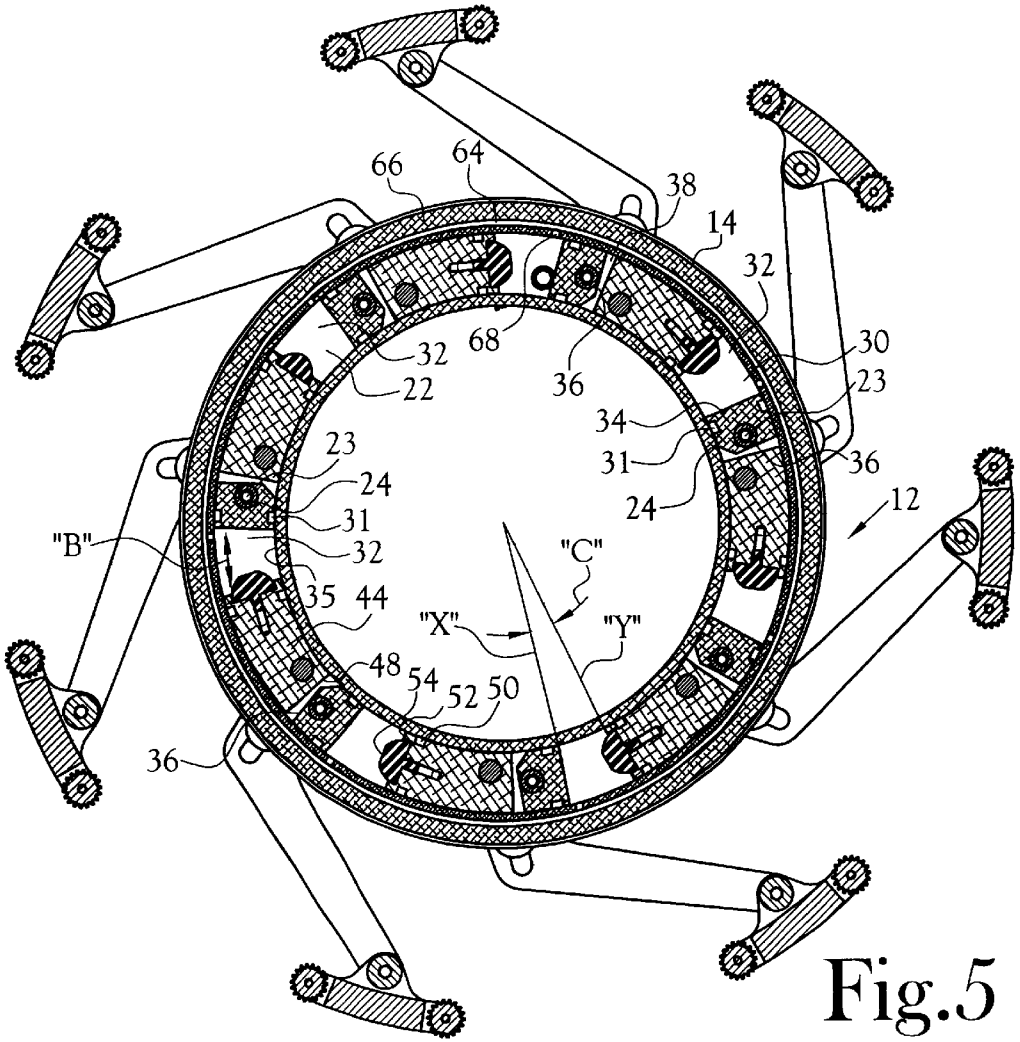
FIG. 5 is an enlarged sectional side elevational view of the mandrel depicted in FIG. 2 and taken along the line 5—5 of FIG. 4.
Figure 4:
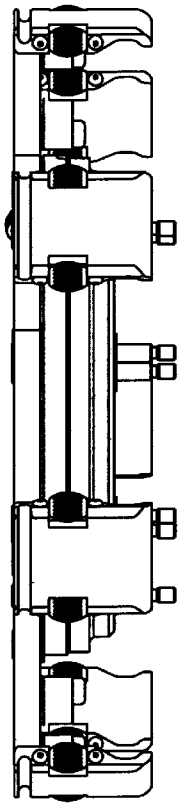
FIG. 4 is a side elevation view of the mandrel depicted in FIG. 2.
Figure 3:
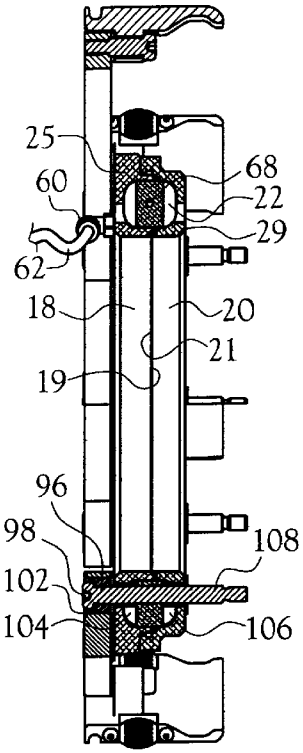
FIG. 3 is a sectional side elevation view of the mandrel depicted in FIG. 2 and taken along the line 3—3 of FIG. 2.
Figure 7:
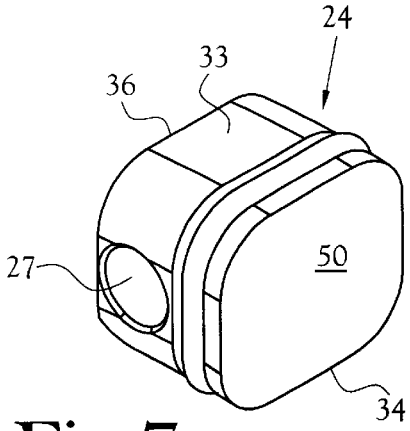
FIG. 7 is a perspective view of one embodiment of a partition member employed in the present invention.
Figure 10:
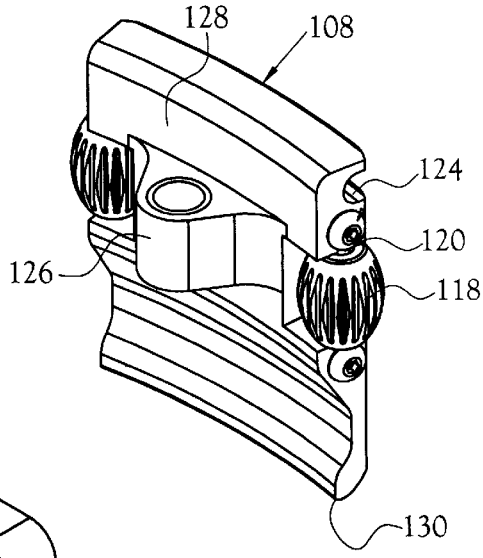
FIG. 10 is a perspective view of the innermost side of the working element depicted in FIG. 9.
Figure 13:
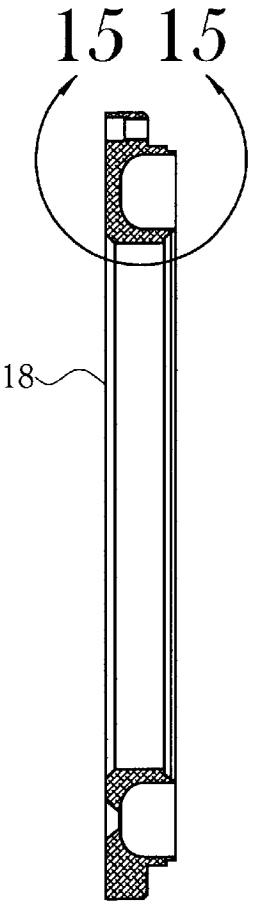
FIG. 13 is a side view, in section, of the housing portion depicted in FIG. 12 and taken along the line 13—13 of FIG. 12.
Figure 17:
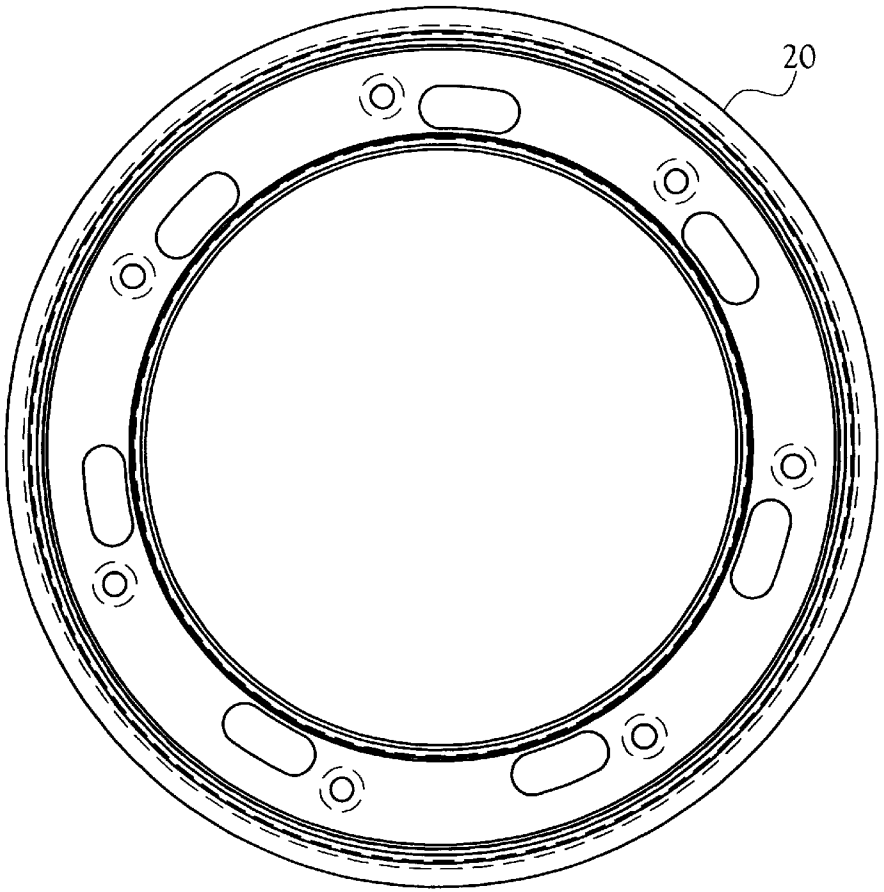
FIG. 17 is an end elevational view of the housing portion depicted in FIG. 16.
Figure 16:
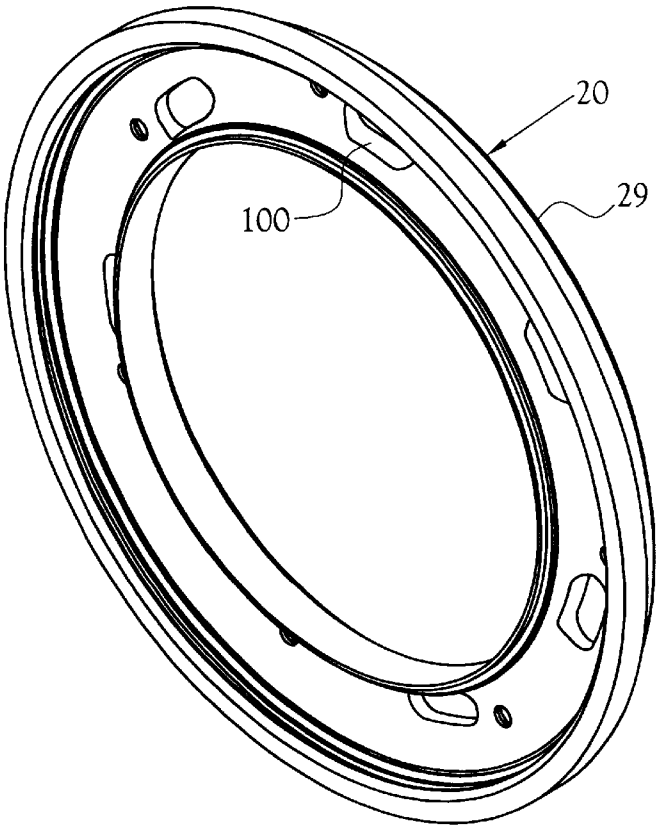
FIG. 16 is a perspective view of the right hand portion of the two-piece housing depicted in FIGS. 1–5.
Figure 20:
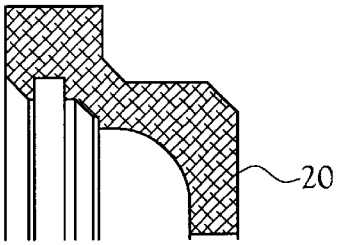
Figure 19:
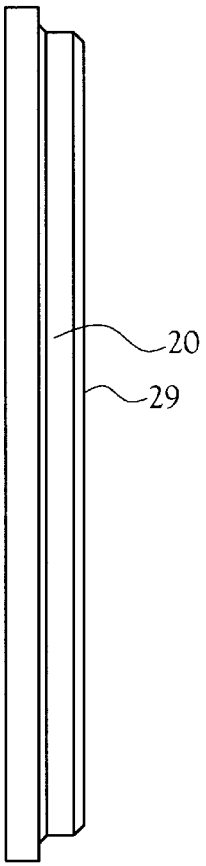
FIG. 19 is a side elevational view of the housing portion depicted in FIG. 17; and, FIG. 20 is an enlarged sectional view of the area 20—20 of FIG. 18.
Figure 18:
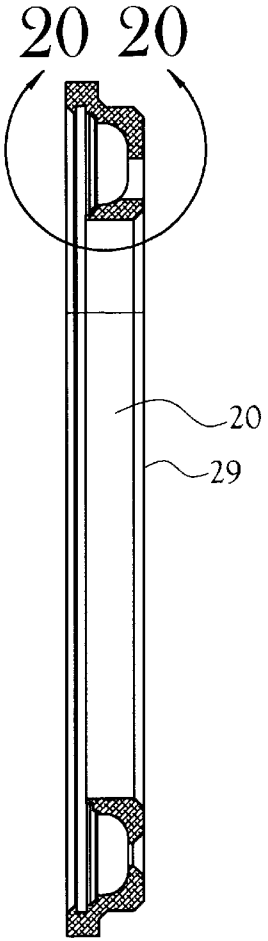
FIG. 18 is a side view, in section, of the housing portion depicted in FIG. 17 and taken along the line 13—13 of FIG. 12.

As depicted in FIGS. 3 and 5, (See also FIGS. 11–20) in particular, the housing 14 is defined by first and second rings 18,20, respectively, each ring having a generally hemispherical cross-sectional geometry. (FIGS. 13 and 18). These rings 18,20 are joined together about their respective distal rims to define the hollow toroidal housing 14. Within the toroidal internal volume 22 of the housing 14, there is provided a plurality of individual partition members 24 (FIG. 5) that are spaced apart from one another, equidistantly in the depicted embodiment, about the circumferential dimension of the toroidal internal volume of the housing. Referring also to FIG. 7, each partition member 24 is fixedly secured transversely across the toroidal internal volume of the housing, as by means of a bolt 23 which extends through a first outer side wall 25 of the housing to be received within a throughbore 27 provided in the partition member, thence to threadably engage a second opposite outer side wall 29 of the housing. Each partition member further is provided with an "O"-ring seal 31 encircling the girth of the partition member and thereby disposed between the outer wall 33 of the partition member and the inner circumferential wall 35 of the housing to thereby ensure fluid-tight engagement with the inner circumferential wall of the housing to thereby divide the internal volume of the housing into individual fluid-tight compartments 32 of equal individual volume. Each partition member 24 includes a first and second ends 34,36, respectively, the first end 34 of a first partition member 24 defining one end 30 of a compartment 32 and the second end 36 of an adjacent a second partition member 24 defining an opposite end 38 of a compartment 32.

Figure 6:
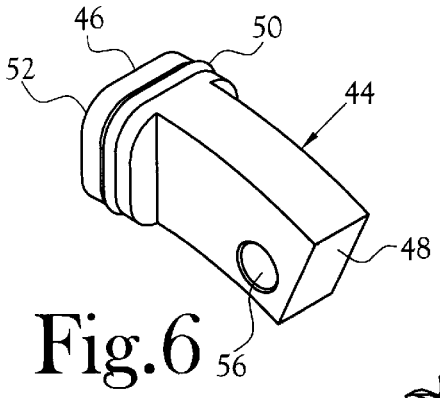
FIG. 6 is a perspective view of one embodiment of a piston member employed in the present invention.

As best seen in FIG. 5, a plurality of piston members 44 are disposed within the toroidal housing, one piston member being disposed within each of the compartments 32. Referring also to FIG. 6, each piston member 44 includes a first and second end 46, 48, respectively, and is of a length such that each piston member is slidable within its compartment between adjacent ones of the partition members. As will be noted hereinafter, the distance which each piston is free to move need only be relatively short to effect a desired radial movement of its associated linkage. Referring to FIGS. 5 and 6, each piston member is of an overall generally curved geometry when viewed in a side elevational view (FIG. 5). This curvature of the piston is of essentially the same curvature of the internal toroidal volume of the housing, whereby each piston is slidable along a circular (curved) path (See arrow "B" of FIG. 5) within its respective compartment. Each piston member includes an "O"-ring seal 50 encircling the piston member adjacent its first end, and being disposed in fluid-tight sealing relationship between the outer circumference of the piston member and the inner circumferential wall of the housing. As seen in FIG. 5, upon movement of a piston member in a counter clockwise direction (as viewed in FIG. 5), the second end 48 of the piston engages the second end 36 of an adjacent partition member to halt counter clockwise movement of the piston member. Movement of the piston in a clockwise direction is halted upon the first end of the piston engaging the facing first end of the other of the adjacent partition members which define the compartment within which the piston is disposed. In the depicted embodiment, the outer face 52 of the first end of the piston member is provided with a shock-absorbing bumper 54 of a polymeric or rubber material for purposes of reducing the wear on the face of the piston member and its stop partition member and to dampen any noise created by the impact of the piston face with the partition member. The opposite end of the piston is provided with a throughbore 56 which is adapted to receive therethrough a connector as will be described further hereinafter.

Pressurized fluid for simultaneous activation of all of the piston members disposed within the circular volume of the housing is effected in the depicted embodiment by the admission of pressurized fluid, preferably air) from a source (not shown) via a conduit 62 which is connected in fluid flow communication with an inlet fitting 60 which is in fluid flow communication with a circular passageway 64 which extends fully around the outer circumferential margin 66 of the housing. In the depicted embodiment, at a location adjacent the first end of each partition member, and between the first end of the partition member and the first end of the piston member, there is provided a bore 68 which leads from the passageway 66 into the interior of each chamber defined about the circumference of the housing. The bore associated with each chamber is of the same size and length so that upon the introduction of pressurized fluid into the passageway, the pressurized fluid will flow fully along the length of the passageway and further will flow substantially simultaneously into each of the chambers that are disposed about the circular housing, at a location between the first end of a piston and the first end of its respective associated adjacent partition member. This pressurized fluid thereby provides the force to urge each of the piston members, substantially simultaneously, in a counter clockwise direction within their respective chambers as viewed in FIG. 5.

Whereas in most applications is desired that all of the pistons move simultaneously in the same direction, either clockwise or counterclockwise, along the length of their respective chambers, it will be recognized that by changing the location of the bore through which pressurized fluid is introduced to a given chamber from a location between the first end of a piston and its associated partition, to a location between the second end of the piston and its associated partition, the direction of movement of this piston may be changed from counter clockwise to clockwise. This type change can be made for all the pistons, but if it is desired that a portion of the pistons move clockwise and another portion of the pistons simultaneously move counterclockwise within the housing, the change of location of the bore associated with only selected chambers may be made.

Figure 9:
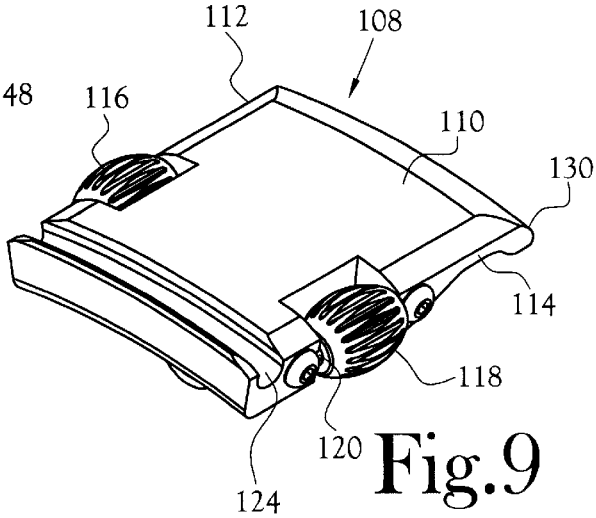
FIG. 9 is a perspective view of the outermost side of one embodiment of a working element adapted to be employed in the present invention.

Referring still to FIGS. 1–5, and further to FIG. 9, the depicted apparatus further includes a plurality of generally elongated linkages 70, each of which includes a proximal body portion 72 and a distal body portion 74 and a proximal end 76 and a distal end 78. The proximal and distal body portions of each linkage includes a longitudinal dimension 80 and 82, respectively, which centerlines intersect at the juncture 84 of the two body portions. Adjacent this juncture 84, the proximal body portion of each linkage is provided with a throughslot 86. A shouldered bolt 88 is inserted through the throughslot, thence through a first opening 90 in the outer side wall 25 of the housing, thence passes through the throughbore 27 in a partition member 24, and is anchored in the second outer sidewall 29 of the housing at a location adjacent the outer circumferential margin 66 of the housing. Thus, this bolt 88 further fixedly anchors an associated one of the partition members 24 within the housing 14 and is of a size and is designed to permit the sliding of the bolt within the throughslot 86 of the linkage over the length of this throughslot.

Figure 8:
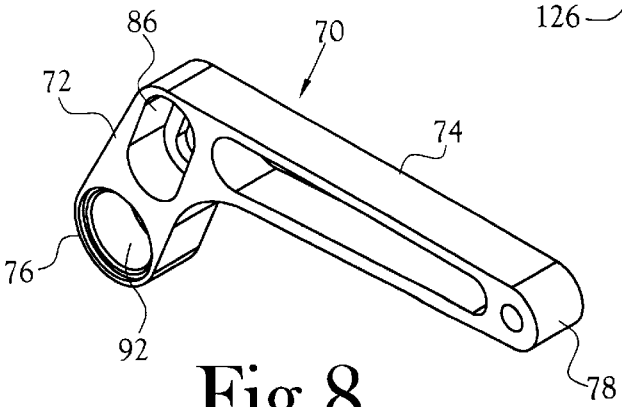
FIG. 8 is perspective view of one embodiment of a linkage employed in the present invention.
Figure 12:
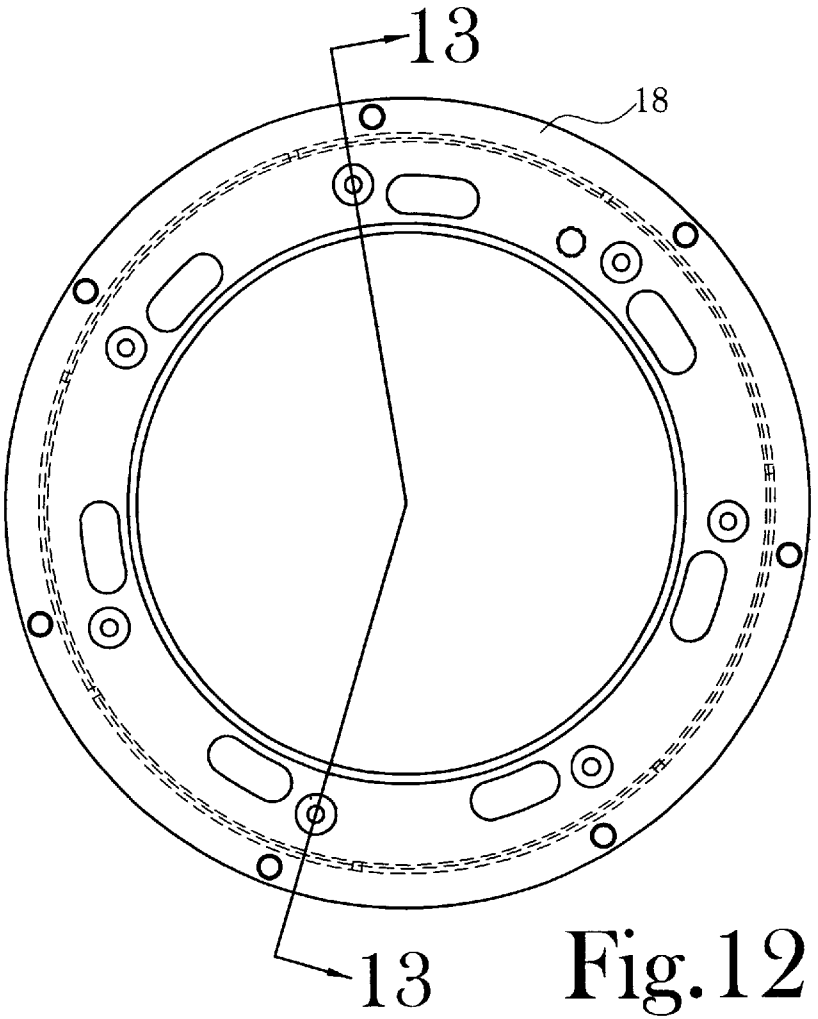
FIG. 12 is an end elevational view of the housing portion depicted in FIG. 11.
Figure 11:
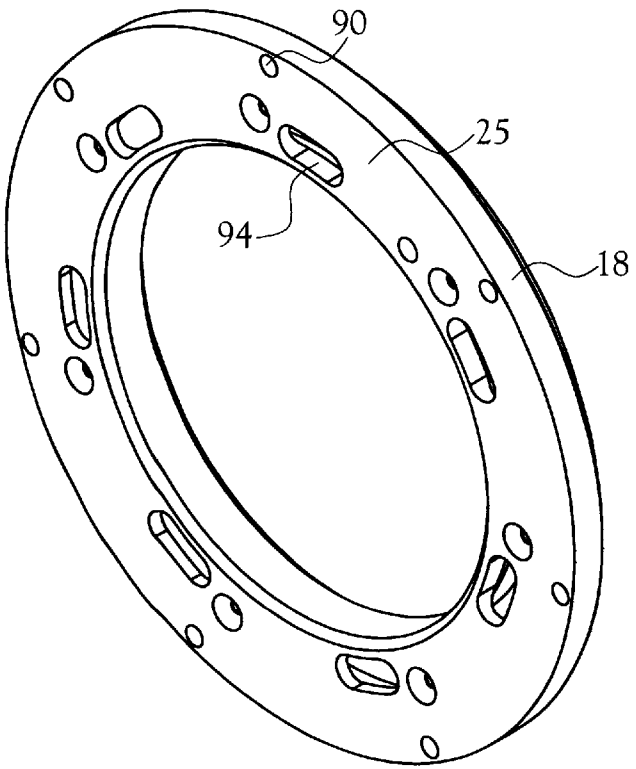
FIG. 11 is a perspective view of the left hand portion of the two-piece housing depicted in FIGS. 1–5.
Figure 15:
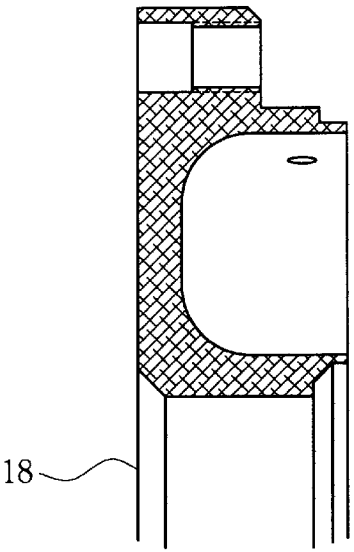
FIG. 15 is an enlarged sectional view of the area 15—15 of FIG. 13.
Figure 14:
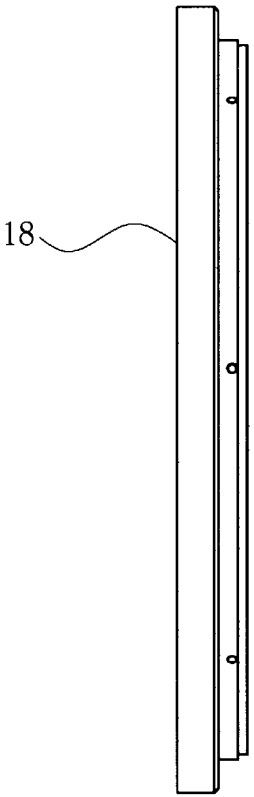
FIG. 14 is a side elevational view of the housing portion depicted in FIG. 12.

Further, and referring specifically to FIGS. 3, 5, and 8, the proximal end 76 of each linkage is provided with a throughbore 92 which registers with an elongated throughslot 94 provided in the first outer wall 25 of the housing. This proximal end of the linkage is pivotally mounted on one end 96 of a shouldered bolt 98 which extends through the throughbore 92 and through the registering throughslot 94 in the sidewall of the housing, thence into and through a respective chamber, thence through a throughbore 56 adjacent the second end of a piston member disposed within the chamber, thence through a registering further throughslot 100 in the opposite second side wall 29 of the housing. As shown in FIG. 3, a threaded standoff 102 may be provided on the end 96 of the bolt, and drill bushings 104,106 may be provided about the bolt and between the inner wall of the housing and the opposite sides of the body portion of the piston member In the depicted embodiment, the opposite end 108 of the shoulder bolt projects from the opposite side wall 29 of the housing in position to provide a means for attachment of the mandrel to an existing portion of a vehicle tire drum or the like, as needed or desired. Notably, the orientation of the longitudinal dimension of each of the throughslots 94 and 100 is non-parallel to the longitudinal dimension of the proximal body portion of the linkage, that is, the orientation of the longitudinal dimension of each of these throughslots follows the arcuate (curved) path of reciprocatory movement of a piston member within the housing.

By reason of the interconnection of a piston member to the proximal end of an associated linkage, any movement of the piston is experienced by the proximal end of the linkage. Each linkage is of a rigid material, and since it is pivotally mounted to the housing by the bolt 88 which passes through the thoughslot 86 located at the juncture of the proximal and distal body portions of the linkage, movement of the proximal end 76 of the linkage is translated into radial movement of the distal end 78 of the linkage.

It will be noted that the interior of each chamber which on the non-pressurized side of the piston member in the chamber is open to ambient atmosphere via the throughslots 94 and 100 in the outer walls 25 and 29 of the housing 14 so as to permit free movement of the piston when pressurized fluid is introduced into the chamber adjacent the first end of the piston member.

Figure 1:
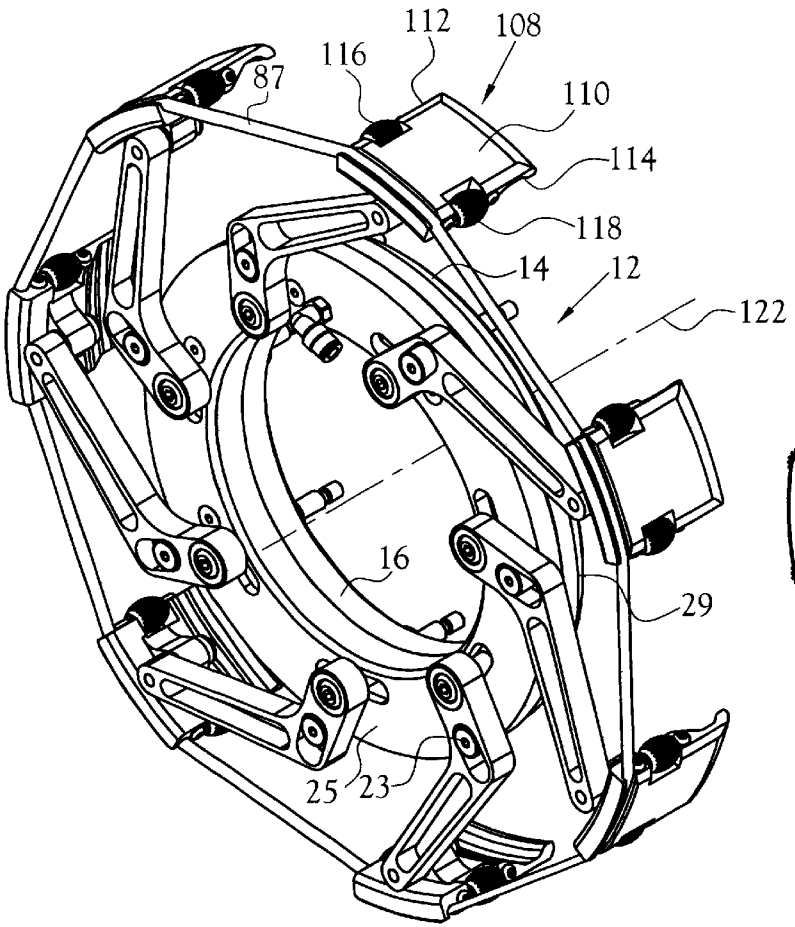
FIG. 1 is a representation, in perspective, of one embodiment of a variable diameter mandrel embodying various of the features of the present invention.

In the depicted embodiment, the distal end 78 of each linkage is provided with a working member 108, which in the depicted embodiment comprises a swivel-mounted shoe 110 having opposite side edges 112 and 114, each of which is provided with a serrated roller 116,118. The axis of rotation 120 of each roller is aligned perpendicular to the rotational axis 122 of the mandrel. Each shoe in the depicted embodiment is provided with a mounting lug 126 on one surface 128 thereof which is adapted to swivelably mount the shoe to the distal end 78 of a linkage 70. These shoes are useful in aligning a green carcass on a shaping drum, for example. As depicted in FIG. 1, for example, the shoes of each linkage of the mandrel are encircled by an elastic band 87 which resides in the channels 124 of the several shoes. By this means, the shoes, hence the distal ends of the linkages are all biased radially inwardly toward the housing of the mandrel, thereby biasing each of the piston members in a direction which minimizes the volume of the space within a given chamber which is to be pressurized for actuation of the piston. Further, the elastic band restricts rotational movement of the shoes to a few degrees of rotation, thereby maintaining the orientation of the outer surface of each shoe generally concentric with respect to the outer circumference of the mandrel, but allowing a relatively small degree of freedom of rotation to provide for alignment of each shoe such that its distal edge 130 properly engages the inner circumference of a tire carcass adjacent a respective bead ring when employed in a shaping drum. This elastic band is not shown in most of the drawings for purposes of clarity.

Figure 2:
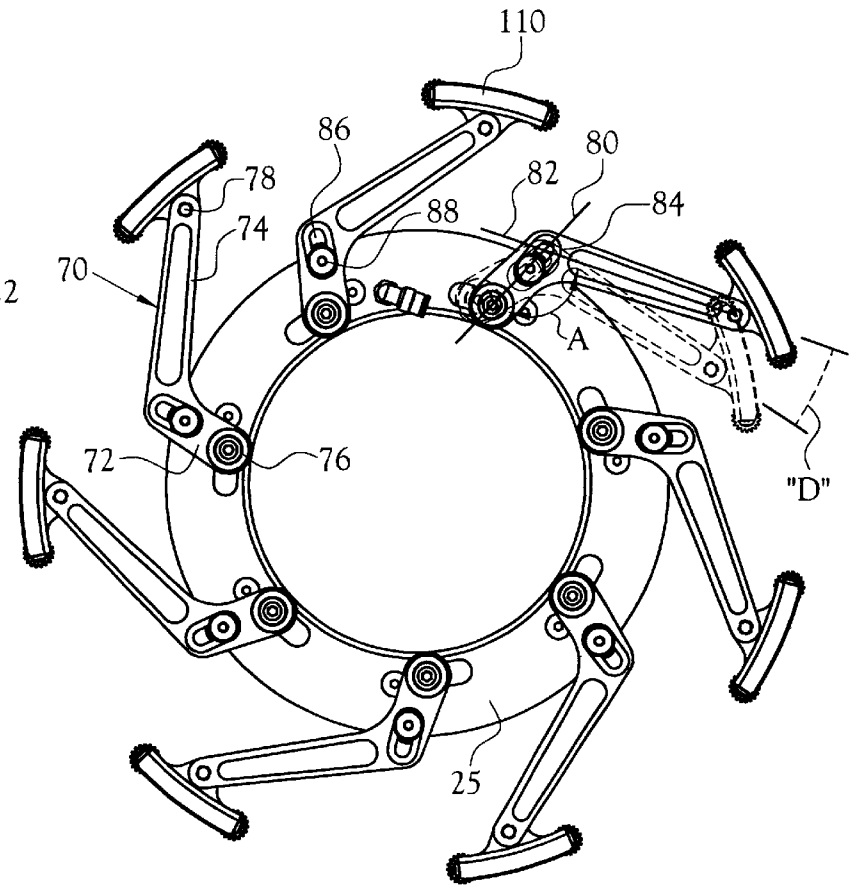
FIG. 2 is an end elevational view of the mandrel depicted in FIG. 1.

In one example, the mandrel of the present invention may be employed in a shaping drum as an aid to alignment of a green vehicle tire carcass on the shaping drum. In this example, for a carcass having a diameter of about 14 inches, the outer diameter of the housing 14 is 10.5 inches and has a cross-sectional area of about 0.27 $in^2$, the overall length of each linkage is 5.5 inches, as measured along the intersecting longitudinal dimensions of the proximal and distal body portions of the linkage (see FIG. 2). In this example, the length dimension of the proximal body portion is 1.5 inches and the length dimension of the distal body portion is 4.0 inches. As depicted in FIG. 2, these intersecting longitudinal dimensions defines an angle "A" which in the present example is 24°. The throughslot through the linkage at the juncture of the proximal and distal body portions is of a length of 0.7 inch. The length of each of the through slots 94 and 100 through the walls of the housing is 0.7 inch. The total permissible distance of travel of the piston member in one direction is through an arc defined by the central angle "C" between radii "X" and "Y" depicted in FIG. 5, each radius being about 3.5 inches in length. Employing components of the foregoing listed dimensions provides for about 3 inches of travel of the distal end of the linkage in a direction substantially radially toward or away from the housing, hence an overall change in the effective diameter of the mandrel of about 6 inches. It will be recognized that other combinations of linkage design and the interconnection of the linkage to the piston member may be employed to obtain other distances and/or speeds of movement of the distal ends of the linkages. For example, the angle "A" defined by the longitudinal dimensions of the distal and proximal body portions of a linkage may vary from between about 15 to about 175 degrees, or in certain applications there may be no angle "A".

Notably, in accordance with the present invention, the only moving components of the present mandrel which are external of the housing are the linkages (and their associated working elements). Further, these linkages are all disposed within a common plane which is adjacent to and parallel to the plane within which the housing is contained. Therefore, the present mandrel occupies a minimum of lateral space within a shaping drum, etc., thereby leaving more unoccupied space within the drum for receipt of other moving components of the drum or, importantly, elimination of exposed components which tend to inhibit the free and full operation of the shaping drum, etc., or also importantly, permits the construction of a laterally more narrow drum which is useful in the fabrication of certain narrow width vehicle tires.

The present invention further provides the advantage of having essentially all of the moving components, other than the rigid linkages, enclosed within the housing and therefore protected against contamination. The present mandrel is mechanically uncomplicated and relatively less expensive to manufacture and to maintain.

Referring to applicant's copending U.S. patent application filed contemporaneously with the present application, which application is included herein in its entirety by reference, in one embodiment of the present invention the present apparatus is useful for centering of a green tire carcass on a shaping drum. "Centering" as used herein and unless otherwise stated or obvious from the context of its use, includes positioning of the bead ring-containing opposite ends of a carcass substantially equidistantly from the centerplane of the drum and substantially radially equidistant from, and substantially concentric about, the rotational axis of the drum. In one embodiment, the shaping drum includes first and second pluralities of positioning shoes disposed about the outer circumference of the drum, these pluralities of shoes being disposed on opposite sides of the lateral centerplane of the drum. In lieu of the first and second pluralities of bidirectional (radial and lateral) positioning wheels disposed about the outer circumference of the drum, on opposite sides of the lateral centerplane of the drum, and between respective ones of the pluralities of shoes and the lateral centerplane of the drum disclosed in the aforesaid copending application, the roller-bearing shoes depicted in FIGS. 1–5 of the present application are employed. In either instance, the shoes and wheels/rollers are selectively positionable radially of the drum.

Whereas herein the term "bolt" has been used as a specific means for interconnecting various of the working components of the present apparatus, it will be recognized by one skilled in the art that other connectors may be employed to perform the same function, such as stub shafts, headed screws, friction fitted pins, etc. Further, in the embodiment depicted in the several Figures, there are shown seven piston members which are equally spaced apart about the circumference of the toroidal inner volume of the housing, however, one skilled in the art will recognize that more or fewer piston members may be employed. Similarly, the cross-sectional area of the toroidal volume of the housing may be varied to accommodate a specific application.

What is claimed:

1. Apparatus for converting circular motion into radial motion comprising a toroidal hollow housing having a circumferential inner wall and first and second outer side walls, a plurality of partition members fixedly disposed inside said hollow housing and in fluid-tight relationship to said inner wall of said housing and at spaced apart locations around said toroidal hollow housing, said partitions dividing said housing into a plurality of individual chambers, a plurality of piston members disposed within respective ones of said plurality of individual chambers, each of said piston members being slidable within its respective chamber and between a first position adjacent a first one of said partition members and a second position adjacent a second one of said partition members, a fluid flow passageway from a location internally of each of said individual chambers and between said piston and one of said partition members to a source of pressurized fluid, a plurality of linkages, each having a proximal end and a distal end, operatively associated with said housing and said piston members whereby circular movement of said pistons within said housing produces substantially radial displacement of said distal end of each linkage.

2. The apparatus of claim 1 wherein said partition members are spaced equidistantally apart from one another within said housing.

3. The apparatus of claim 1 wherein each of said linkages includes a proximal body portion and a distal body portion, said proximal body portion and said distal body portion each having a longitudinal dimension and wherein said longitudinal dimensions of said proximal and said distal body portions intersect intermediate the proximal and distal ends of said linkage to define an acute angle between said longitudinal dimensions.

4. The apparatus of claim 3 wherein said angle is between about 15 degrees and about 175 degrees.

5. The apparatus of claim 4 wherein said longitudinal dimension of said proximal body portion is not greater than the longitudinal dimension of said distal body portion.

6. The apparatus of claim 1 and including a resilient band encircling said distal ends of said linkages and urging said distal ends toward their most radially inward positions relative to said circular housing.

7. The apparatus of claim 3 and including means defining a first throughslot in said proximal body portion of each of said linkages at a location adjacent said juncture of said proximal and distal body portions of said linkage, a throughbore in said first outer wall of said housing, and a connector extending through said first throughslot, through said throughbore in said first outer wall of said housing, into an associated chamber of said housing, and through a registering throughbore in said partition member associated with said associated chamber, said throughslot having a longitudinal dimension which is oriented substantially parallel to the longitudinal dimension of said proximal body portion of said linkage.

8. The apparatus of claim 7 wherein said connector extends fully through said piston member and exits said chamber at a location opposite its location of entry into said chamber, said connector projecting from said exit location.

9. The apparatus of claim 7 wherein each of said piston member includes a throughbore extending between first and second opposite sides thereof, a throughbore extending through said proximal end of said linkage, and including a throughslot in said wall of said housing at a location in register with said throughbore extending through said piston member disposed within said housing, and a connector extending through said throughbore of said linkage, through said throughslot in said housing wall and entering said housing, thence being received within said throughbore of said piston member, and being either anchored in said housing at said exit location or exiting said housing at a location diametrically opposite the entry location of said connector, thereby anchoring said partition member against movement within said housing, said second throughslot having a longitudinal dimension which is oriented non-parallel to said longitudinal dimension of said proximal body portion of said linkage.

* * * * *